US005711572A

United States Patent [19]

Khan

[11] Patent Number: 5,711,572

[45] Date of Patent: Jan. 27, 1998

[54] FOLDABLE TABLE AND SEAT ASSEMBLY

[75] Inventor: Shaukat A. Khan, San Antonio, Tex.

[73] Assignee: Bonair Rehabilitation Services, Inc., San Antonio, Tex.

[21] Appl. No.: 685,192

[22] Filed: Jul. 18, 1996

[51] Int. Cl.[6] ..... A47B 3/14; A47B 83/02

[52] U.S. Cl. ..... 297/140; 297/14 R; 297/159.1; 297/173; 297/174; 297/440.12; 297/440.15

[58] Field of Search ..... 297/140, 141, 297/142, 157.1, 158.2, 159.1, 173, 174, 440.12, 440.15; 108/27, 115

[56] References Cited

U.S. PATENT DOCUMENTS

| | | | |
|---|---|---|---|
| D. 134,806 | 1/1943 | Brown et al. . | |
| 168,661 | 10/1875 | Miller . | |
| D. 190,806 | 7/1961 | Emery . | |
| 372,881 | 11/1887 | Underwood | 297/141 |
| 1,127,139 | 2/1915 | West | 108/27 |
| 1,256,811 | 2/1918 | McNamara | 297/172 |
| 1,321,732 | 11/1919 | Girard | 297/141 |
| 1,548,488 | 8/1925 | Schibrowski . | |
| 1,879,649 | 9/1932 | Wilkinson | 108/115 |
| 2,418,731 | 4/1947 | Seitz . | |
| 2,528,676 | 11/1950 | Walters . | |
| 2,822,860 | 2/1958 | Galabrese . | |
| 2,940,511 | 6/1960 | Gomes . | |
| 3,123,935 | 3/1964 | Williams . | |
| 3,168,061 | 2/1965 | Bedol . | |
| 4,228,745 | 10/1980 | Gale . | |
| 4,359,243 | 11/1982 | Crutcher . | |
| 4,520,897 | 6/1985 | Gebo . | |
| 4,648,658 | 3/1987 | Calco | 297/440.12 |
| 4,679,509 | 7/1987 | Sampson | 297/174 |
| 5,067,417 | 11/1991 | Marmentini et al. . | |
| 5,489,144 | 2/1996 | Lewisr . | |

OTHER PUBLICATIONS

J. A. Preston Corporation; 1994 Product Catalog; p. 14 Universal Corner™ Chair; J. A. Preston Corporation, P.O. Box 89, Jackson, MI 49204.

Best Priced Products, Inc.;Catalog (Exp date Mar. 1, 1995); p. 33 Skillbuilders corner chair; Best Priced Products, Inc., P.O. Box 1174, White Plains, New York 10602.

Independent Living Aids, Inc.; Product Catalog No. 990 (no publication date); p. 25 Corner Seat; Independent Living Aids, Inc., 447 E. Mall, Plainview, N.Y. 11803.

*Primary Examiner*—Peter M. Cuomo
*Assistant Examiner*—Anthony D. Barfield
*Attorney, Agent, or Firm*—Jenkens & Gilchrist

[57] ABSTRACT

A foldable seat is pivotally attached to at least one leg of the foldable table. In a folded position, the folded seat is positioned adjacent the bottom surface of the table. The spacing between the seat and the table, when disposed in an operable position, is selectively adjustable. The legs of the table are adjustable both for length and angular relationship with respect to the bottom surface of the table.

8 Claims, 4 Drawing Sheets

FOLDABLE TABLE AND SEAT ASSEMBLY

BACKGROUND OF THE INVENTION

1. Technical Field

This invention relates generally to a foldable table and seat assembly, and more particularly to such an assembly in which the seat is pivotally attached to at least one of the legs of the table.

2. Background Art

Folding tables and folding chairs are well-known, and when carried in a folded position typically require the use of separate hands to carry the table and the chair. This requirement prevents the simultaneous carrying of other articles or materials. Thus, although the folding table and folding chair are separately highly portable, they occupy the full manual capacity of a person transporting the table and chair. Also, when not in use, the table and chair must be stored as individual separate units.

Furthermore, many folding table and folding chairs are intended primarily for adults and are not readily adapted for use by toddlers or younger people. Typical folding tables and chairs are not particularly attractive to young people, nor are they designed to encourage use by younger people.

Still further, typical folding tables and chairs are not designed to withstand hard use, and are often of lightweight construction which makes them susceptible to tipping and sliding away from the chair when leaned upon by young people. Furthermore, typical folding tables and chairs are relatively expensive to manufacture and are often unwieldy or difficult to set up for use.

The present invention is directed to overcoming the problems set forth above. It is desirable to have a foldable table and seat assembly that can be easily carried in one hand. It is also desirable to have such a foldable table and seat assembly that is storable as a single integral unit when not in use. Furthermore it is desirable to have such a foldable table and seat assembly that is particularly attractive to younger people and designed to encourage use by younger people. Still further it is desirable to have such a foldable table and seat assembly that is not easily damaged, is stable during use, easy to set up, and is economical to produce from relatively low cost materials.

SUMMARY OF THE INVENTION

In accordance with one aspect of the present invention, a foldable table and seat assembly includes a table having a plurality of legs each of which are movable between a folded position at which each leg is disposed at a position substantially parallel with the bottom surface of the table and an operable position at which each of the legs extends outwardly from the bottom surface. The foldable table and seat assembly also includes a seat that is pivotally attached to at least one of the legs of the table and is movable from a folded position at which the seat is disposed adjacent the the table and an operable position of which the seat is spaced from the bottom surface of the table.

Other features of the foldable table and seat assembly embodying the present invention include the foldable seat having a planar bottom panel and two planar side panels. At least one of the side panels is foldably attached to the bottom panel. Each of the side panels are movable between a folded position at which each of the side panels is disposed in parallel relationship with the bottom panel and an operable position at which the side panels are substantially orthogonally disposed with respect to the bottom panel and each other.

Still other features of the foldable table and seat assembly embodying the present invention include a means for maintaining the bottom panel and side panels of the seat at the operable position, and each of the legs of the table having an individually adjustable length and angular adjustability with respect to the bottom surface of the table.

In accordance with another aspect of the present invention, a foldable seat adaptable for removable, pivotable attachment to a table leg includes a planar bottom panel and two planar side panels at least one of which is foldably attached to the bottom panel. Each of the side panels are movable between a folded position at which the respective side panel is disposed in parallel relationship with the bottom panel and an operable position at which the respective side panel is substantially orthogonally disposed with respect to the bottom panel and to the other side panel. Other features of the foldable seat embodying the present invention include a first one of the side panels being attached to the bottom panel by a hinged connection, the second one of the side panels being attached to the first side panel by a hinged connection and having an opening extending through the second side panel at a predetermined position.

Other features of the foldable seat include a means for maintaining the bottom panel and the side panels at the operable position. In one embodiment the means for maintaining the bottom panel and the side panels at the operable position include a threaded pin fixedly attached to the bottom panel and extending outwardly from the bottom panel in coplanar relationship, at a position aligned with an opening through one of the side panels when the side panels are positioned at the operable position, and a threaded nut adapted to threadably engage the threaded pin.

BRIEF DESCRIPTION OF THE DRAWINGS

A more complete understanding of the structure and operation of the present invention may be had by reference to the following detailed description when taken in conjunction with the accompanying drawings, wherein.

DETAILED DESCRIPTION OF A PRESENTLY PREFERRED EXEMPLARY EMBODIMENT

Figure 1:
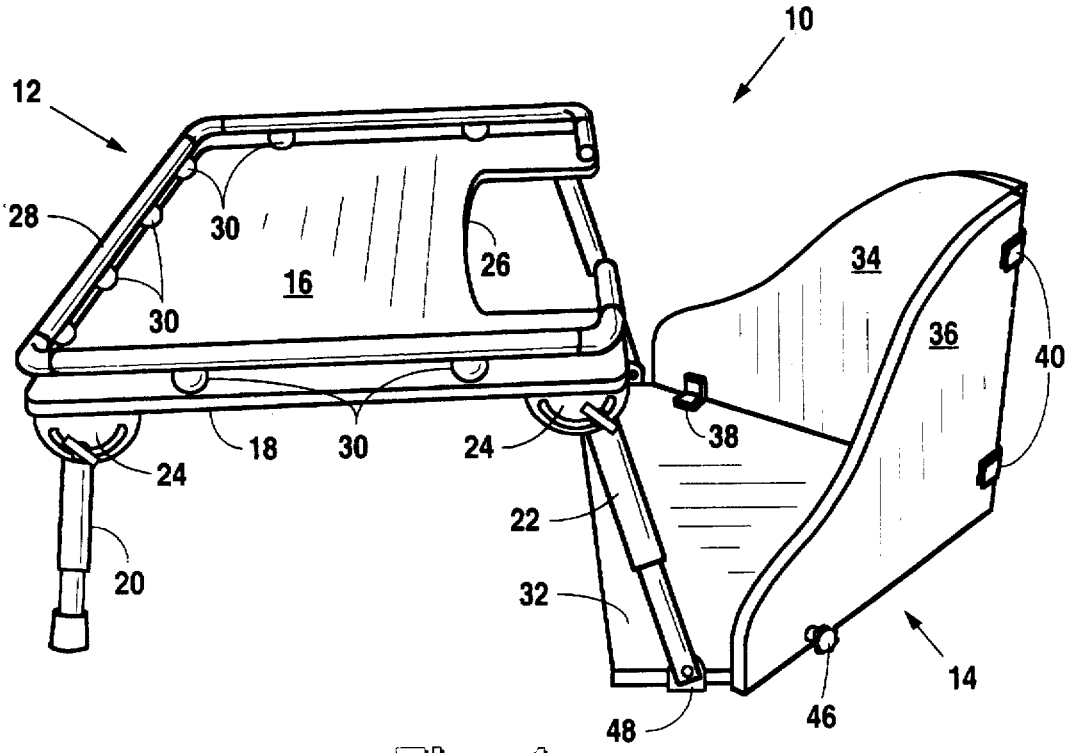
FIG. 1 is a perspective view of a foldable table and seat assembly embodying the present invention, with the assembly disposed at an operable position.
Figure 2:
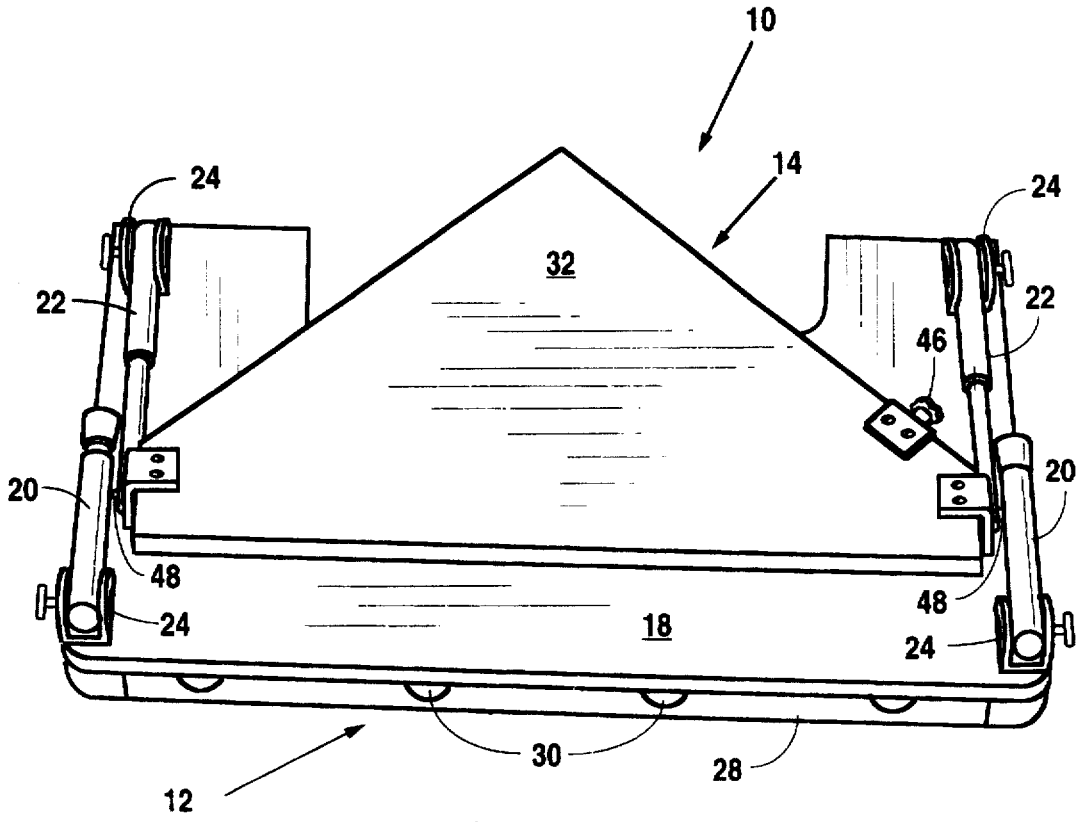
FIG. 2 is a perspective view of the foldable table and seat assembly embodying the present invention, with the assembly shown in a folded position.

A foldable table and seat assembly representative of the preferred embodiment of the present invention is indicated generally in the drawings by the reference numeral 10, and includes a table 12 and a seat 14. The table 12 has a top surface 16, a bottom surface 18, a pair of legs 20 disposed along the front edge of the table 12 and a pair of legs 22 disposed at the rear of the table 12. All four legs, 20, 22 are attached to the bottom surface 18 of the table 12 by conventional pivoting joints which permit each of the legs 20, 22 to be moved from a folded position, as best shown in FIG. 2 at which the legs 20, 22 are disposed in substantially parallel relationship with the bottom surface 18, and a operable position, as best seen in FIGS. 1 and 8 whereat each of the legs 20, 22 extend outwardly from the bottom surface 18 of the table 12.

Desirably each of the legs 20, 22 are selectively extendible or retractable to provide a desired height of the table 12 above a floor surface. The adjustable length of the legs may be provided by conventional telescoping sections which frictionally engage each other to resist relative movement from a desired position. Alternatively, resistance against movement from a set position may be provided by spring-biased balls that engage detents provided in one of the extensible portions of the leg, by pins that extend through aligned apertures provided in both of the telescoping sections of each of the legs 20, 22, collets, or other conventional locking means. The legs 20,22 may also have other configurations such as "T-legs" where the cross member of the "T" is either attached to the table 12, or inverted so that the base of the upright member is attached to the table 12 and the cross member disposed on the floor. Also, the legs 20,22 may be interconnected wherein two of the legs form a "U" shape with the ends of the "U" either attached to the table 12 or inverted so that the ends are in direct contact with the floor. In other arrangements, the table may have either a single front leg 20 or a single rear leg 22 which is stradled by the seat occupant.

Figure 7:
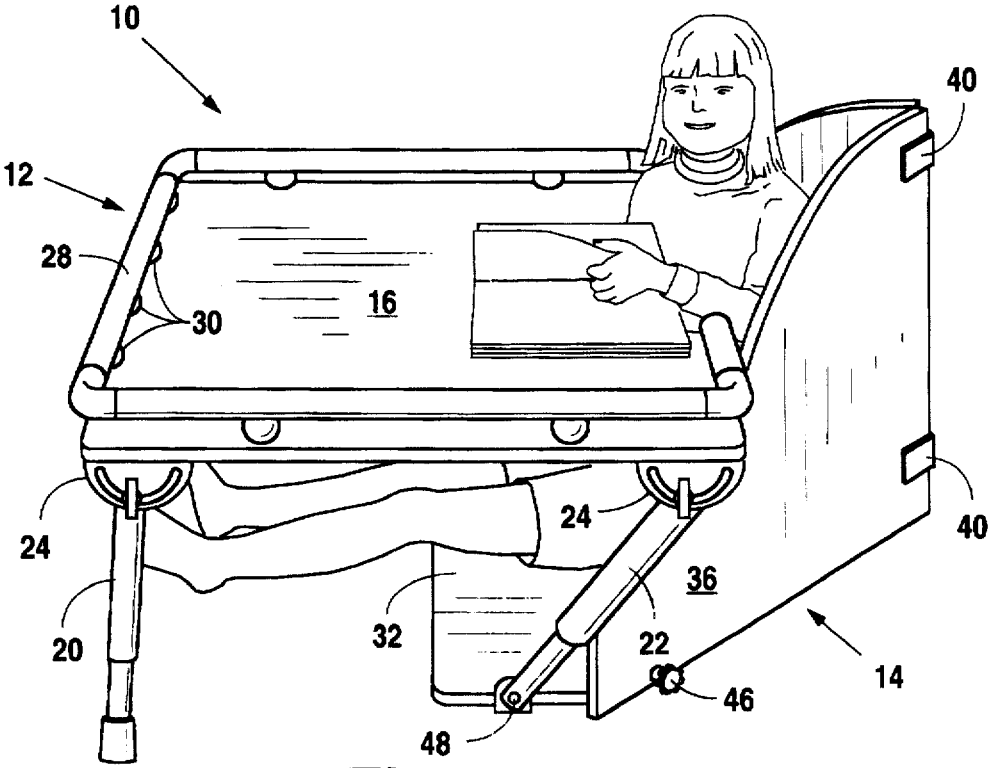
FIG 7 is a perspective view of the foldable table and seat assembly embodying the present invention, in which the seat is moved to a position closer to the table than illustrated in FIG. 1, to accommodate a small child.

Also, it is desirable that each of the legs 20, 22, and in particular the rear legs 22, be maintainable at an selectively adjustable angular position with respect to the bottom surface 18 of the table 12. This feature allows the seat 14 to be positioned at a selected distance from the table 12, depending upon the size of the individual using the foldable table and seat assembly 10. As shown in FIG. 1, the rear legs 22 of the table 12 are angled such that the pivotally attached seat 14 is spaced a greater distance away from the table than is shown in FIG. 7. Thus the seat may be positioned very close to the table for small infants and moved away from the table 12 to allow more space for larger individuals. In the illustrated embodiment, the individual angular adjustment of the legs is conveniently provided by arcuately slotted brackets 24, as shown in the drawings, through which a bolt passing through aligned holes in the legs 20,22 extends and enables the legs 20,22 to be maintained at a selected position in response to tightening a wing nut on the bolt. Alternatively, angular adjustment of the legs may be provided by conventional adjustable bar linkages or similar devices.

Desirably the table 18 has a notched opening 26 in the edge of the table adjacent the seat 12, which is adapted to partially encircle an infant, child or other person when seated in the seat 14. Also, the table 12 may be provided with a decorative rim around other edges of the table 12 such as by a balustrade 28 as shown in the drawings. This feature is especially desirable for younger users of the table, in which the balustrade 28 may be formed of a plurality of brightly colored upright balusters 30 which support the top rail of the balustrade 28. The balustrade 28 not only provides an aesthetic enhancement to the table but also provides a barrier to books, papers, crayons, pencils and other items from falling off the edge of the table 12.

The seat 14 is pivotally attached to at least one of the legs, preferably at least one of the rear legs 22 of the table 12 and is movable from a folded position as shown in FIG. 2 to an operable position as shown in FIGS. 1 and 7. In the folded position, the seat 14 is disposed adjacent to the bottom surface 18 of the table 12 whereas in the operable position, the seat 14 is spaced from the bottom surface 18 of the table 12.

In the preferred embodiment of the present invention, the seat 14 comprises a planar bottom panel 32, a first side panel 34, and a second side panel 36. Preferably, the planar bottom panel 32 is adapted to sit directly on a floor surface. However, if desired, the bottom panel 32 may have rubber pads, feet, or other short supports that space the bottom panel 32 a short distance above the floor surface, attached to the bottom surface. Each of the seat panels 32,34,36 has a rigid construction, but may be covered with a decorative fabric or plastic and even include thin, compressible padding, provided that the padding is of a minimal thickness such that it would not interfere with the foldability and compact store ability of the seat 14.

Figure 5:
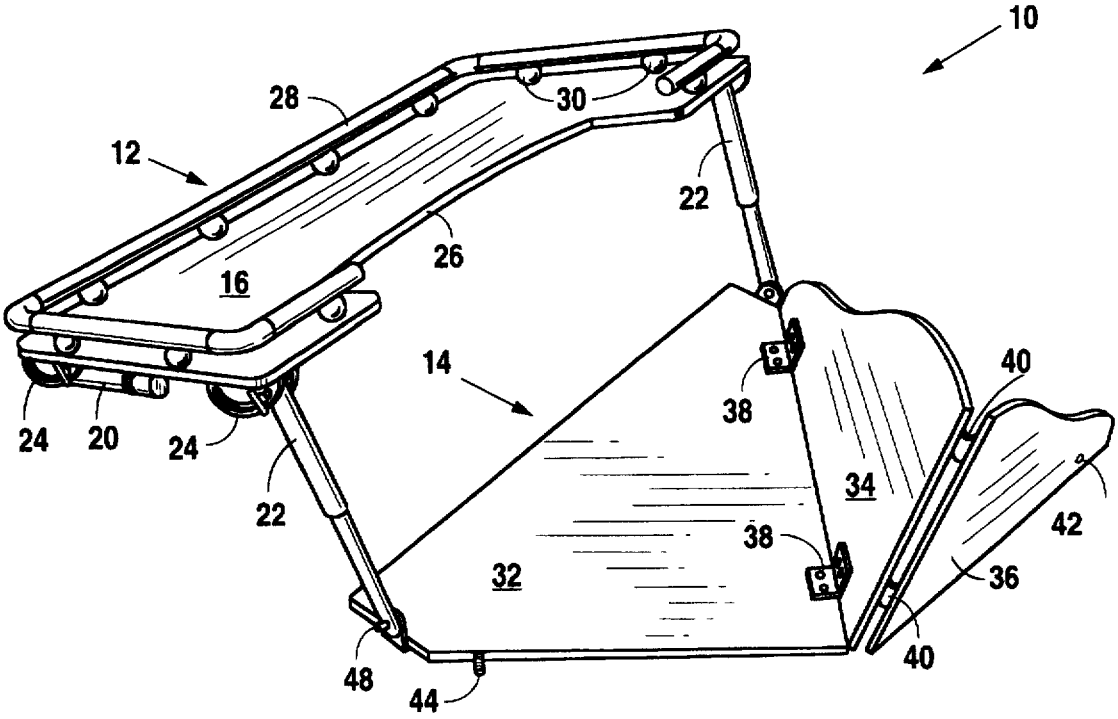

At least one of the side panels 34, 36 is foldably attached, such as by hinges 38, to the bottom panel 32. In the preferred embodiment of the present invention, the first side panel 34 is attached to the bottom panel 32 by a pair of inside hinges 38, as best seen in FIG. 5. The second side panel 36 is attached to the first side panel 34 by a pair of outside hinges 40 as may be seen in FIGS. 5–7. Thus, as may be seen, and as will be explained below in greater detail, each of the side panels 34, 36 are movable between the folded position as seen in FIG. 2, at which the side panels 34, 36 are disposed in parallel relationship with the bottom panel 32 of the seat 14, and an operable position shown in FIGS. 1 and 7, at which each of the side panels 34, 36 are positioned in substantial orthogonal relationship with respect of each other and the bottom panel 32.

Figure 3:
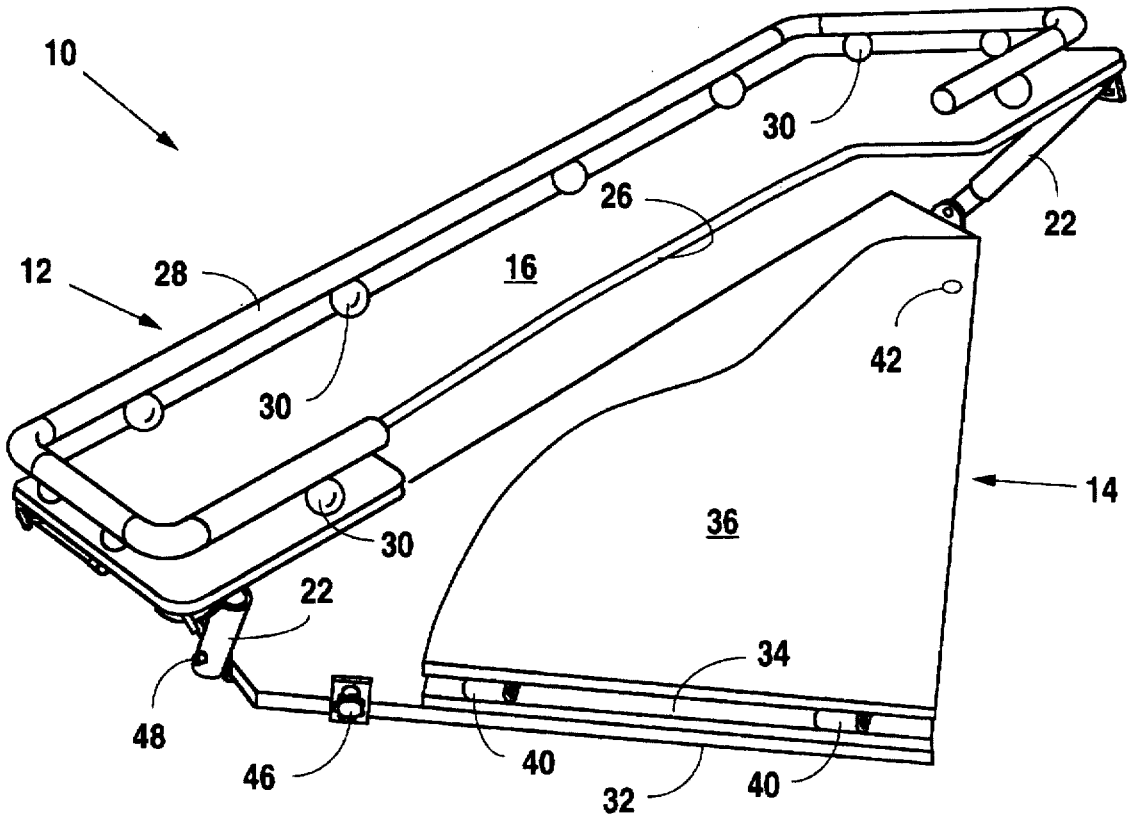
FIGS. 3–6 perspective views of the foldable table and seat assembly embodying the present invention, showing the assembly in sequentially carried out steps of unfolding.
Figure 4:
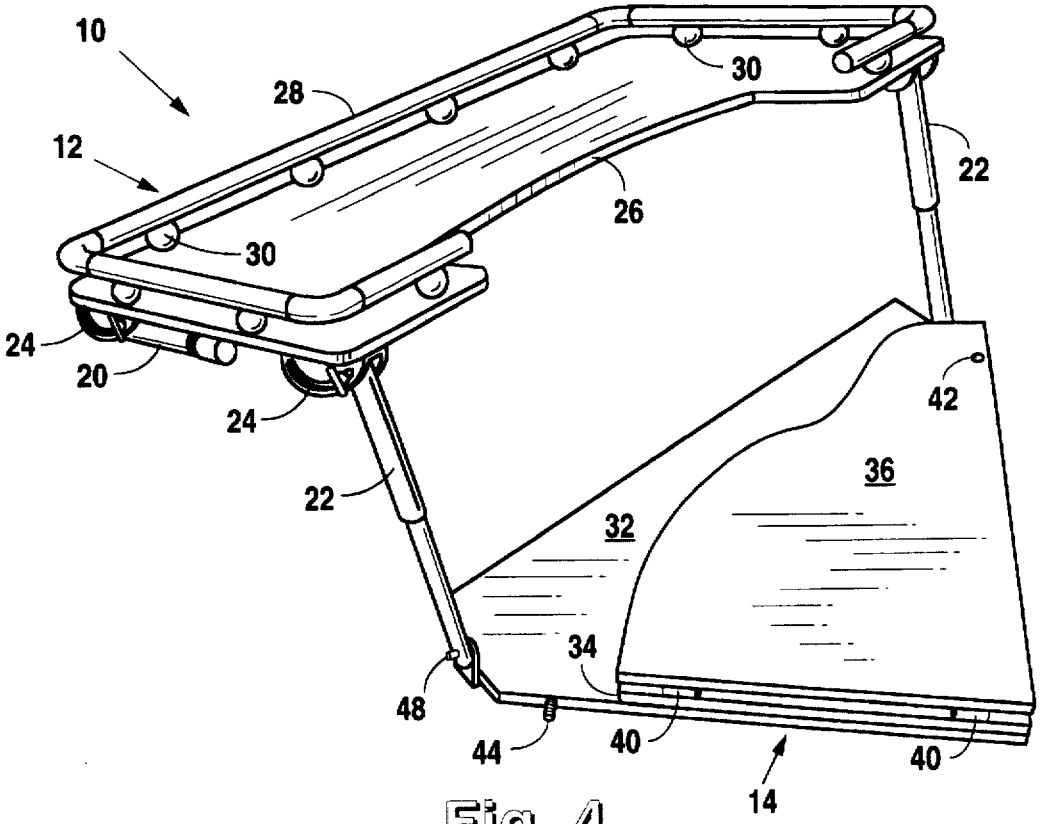

Desirably, the seat 14 also includes a means for maintaining the bottom panel 32 and the side panels 34, 36 at the operable position. In the preferred illustrative embodiment of the present invention a hole 42, as best seen in FIGS. 3–5, extends through a lower portion of the second side panel 36. The means for maintaining the bottom panel 32 and the side panels 34, 36, at the operable position include a threaded pin or stud, 44 which extends outwardly from the bottom panel 32 in substantially coplanar relationship with the bottom panel 32. The threaded stud 44 is positioned so that it is aligned with the opening 42 through the second side panel 36 when the second side panel 36 is positioned at the operable position. After engagement of the threaded stud 44 through the hole 42, the second side panel 36, and accordingly, the first side panel 34, are maintained in a fixed relationship with respect to the bottom panel 32 by a threaded knob-nut 46, as shown in FIGS. 1 and 7.

The pivotable interconnection between the seat 14 and the table 12 is advantageously provided by a pivot pin 48 mounted along at least one side edge of the seat 14 at a position near the forward edge of the seat 14. In the preferred embodiment, the pivot pin 48 is attached to the seat 14 along each of the side edges near the forward edge of the seat 14, so that the pin 48 extends outwardly from both of the lateral side edges of the seat 14. At least one of the rear legs 22 of the table 12 is adapted to receive the pivot pin 48 at a distal end of the leg 22. In the preferred embodiment, both of the rear legs 22 of the table 12 are adapted to receive a respective one of the pivot pins 48 attached to the seat 14. Advantageously, the interconnection between the respective rear legs 22 of the table 12 and the pivot pin 48 attached to the seat 14 is provided by an aperture extending transversely through the distal end of each of the legs 22. If a single rear leg configuration is used, the leg 22 may be attached by a swivel connection to a forward middle edge of the seat 14.

Disassembly, or separation of the seat 14 from the table 12, is readily accomplished by withdrawing the telescoped lower portion of the rear leg, or legs, 22 from the upper, larger diameter, portion of the respective leg. Alternatively, separation of the table and seat may be accomplished by withdrawing the pivot pin 48 from one of the legs 22 whereby the pivot pin 48 is disengaged from the aperture in which it is engaged. If the seat 14 is pivotally attached to two rear legs 22, the other pivot pin 48 may then be easily removed from the second rear leg 22.

Figure 6:
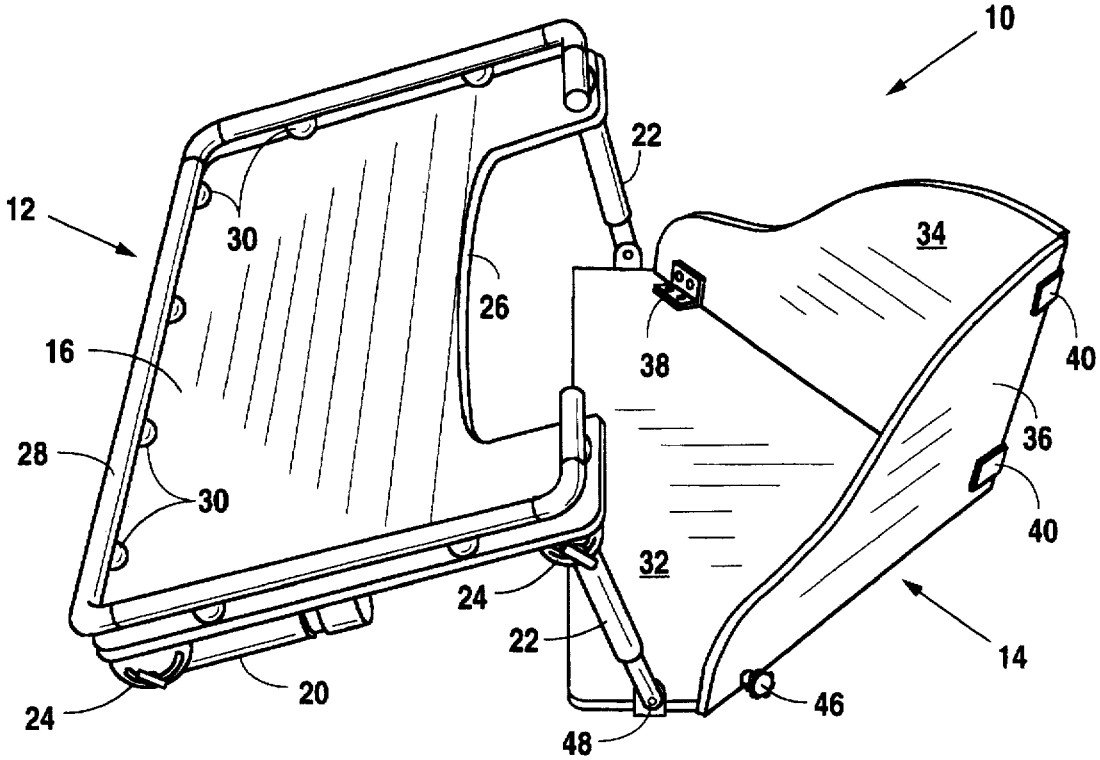

The foldable table and seat assembly 10 embodying the present invention is easily moved from a folded position, as shown in FIG. 2 to an operable position as shown in FIGS. 1 and 7. In the folded position, the assembly 10 typically has, depending upon the thickness of the panels used in the construction of the assembly 10, a thickness of less than about 3½ inches (8.9 cm). Thus the folded assembly 10 is very compact and since it comprises a single interconnected unit, is readily transportable between desired locations. The foldable table and seat assembly 10 is easily convened from the folded position to the operable position as will be described with frequent reference to FIGS. 3–6. In the first step, the folded assembly 10 is inverted from the position shown in FIG. 2, and the seat portion 14 pivoted away from its position adjacent the bottom surface 18 of the table 12, as shown in FIG. 3. The seat 14 is then moved further away from the bottom surface 18 of the table 12 to a position at which it is substantially spaced from the bottom surface 18 of the table 12 with the bottom panel 32 of the seat 14 resting on a floor surface, as shown in FIG. 4. The seat 12 is then opened to its operable position by pivoting the first side panel 34 toward a vertical position with respect to the bottom panel 32, as illustrated in FIG. 5. The second side panel 36 may then be unfolded, bringing it into contact with the bottom panel 32, as shown in FIG. 6, so that the threaded pin 44 provided at the edge of the bottom panel 32 engages the hole 42. The threaded knob-nut 46 is then tightened on the pin 44 thereby locking the side panels 34, 36 and the bottom panel 32 together at the desired operable position.

The position of the seat relative to the notched opening 26 in the table 12 is determined by the angular position and length adjustment of the pivotally attached rear legs 22 of the table 12. The rear legs 22 may be locked in a rearwardly extending angular position as shown in FIG. 1, whereby the seat 14 is significantly spaced away from the rear edge of table 12 to provide space for a larger child or other individual, or pivoted about the end of the leg attached to the angle adjustment brackets 24 to a position shown in FIG. 7, at which the seat 14 is positioned closer to the rear edge of the table 12. After such adjustment, the wing nut associated with each of the angle brackets 24 is tightened to lock the legs 22 at the desired position. Also, as described above, each of the legs 20, 22 have an adjustable length which, after unfolding and angular adjustment, may be extended or retracted as desired to provide a selected height or tilt angle for the table top surface 16 above the floor.

The foldable table and seat assembly 10 may be advantageously formed of conventional materials such as ¼ inch (0.6 cm) plywood for the table surface and seat panels, aluminum tubing for the legs, and conventional hardware for other mechanical interconnection components such as hinges and pivot pins. Alternatively, the table and side panels may be formed of sheet or molded plastic materials such as polyvinyl chloride (PVC) or other plastic materials. When formed of plastic materials, the adjustable angle leg support brackets 24, and the means for attaching the side panels 34,36 to each other and the bottom panel 32 may be selectively integrally molded, or alternatively fabricated by adhesive attachment, with one or more of the table or panel components. The seat 14 may be formed of plastic panels that are mechanically connected in substantially the same manner as shown in the drawings, or alternatively, may be formed of a single sheet that is folded along the respective edges that are pivotally joined by hinges in the drawing. If provided with a decorative balustrade 28, as shown in the drawings, the individual balusters 30 may be provided by brightly colored wooden balls that are secured by screws extending through the top rail, the ball, and into the top surface 16 of the table 12. In this arrangement, the top rail may be conveniently formed of conventional PVC plastic pipe and fittings.

Although the present invention is described in terms of a preferred exemplary embodiment, with specific illustrative constructions and arrangements, those skilled the art will recognize the changes in those arrangements and constructions may be made without departing from the spirit of the invention. For example, both of the side panels 34, 36, of the seat 14 may be attached directly to the bottom panel 32 by hinges and then locked into the desired position by a threaded pin 44 extending outwardly from the vertical edge of one of the side panels 34, 36 through a hole 42 provided along the vertical edge of the other one of the side panels 34, 36. Also, if desired table 12 may be supported by only three legs instead of the four legs illustrated in the described embodiment. Such changes are intended to fall within the scope of the following claims. Other aspects, features, and advantages of the present invention may be obtained from a study of this disclosure and the drawings, along with the appended claims.

What I claim is:

1. A foldable table and seat assembly, comprising:

a table having a top surface, a bottom surface, and a plurality of legs each of which are pivotally attached to the bottom surface of the table and moveable between a folded position at which said leg is disposed at a position substantially parallel with said bottom surface and an operable position at which said leg extends outwardly from said bottom surface; and a seat pivotally attached to at least one of the legs of said table and moveable from a folded position at which said seat is disposed adjacent said table and an operable position at which said seat is spaced from the bottom surface of said table, said seat having a planar bottom panel and two planar at least one of which is foldably attached to said bottom panel, each of said side panels being movable between a folded position at which side panel is disposed in parallel relationship with said bottom panel and an operable position at which said side panel is substantially orthogonally disposed with respect to said bottom panel and the other side panel, a first one of said side panels being attached to said bottom panel by a hinge connection and a second one of said side panels being attached to said first side panel by a hinge connection and having an opening extending through said second side panel at a predetermined position, and a means for maintaining said bottom panel and said side panels at said operable position wherein said means includes a threaded pin fixedly attached to said bottom panel and extending outwardly therefrom in coplanar relationship with said bottom panel at a position aligned with said opening through said second side panel when said second side panel is positioned at said operable position, and a threaded nut adapted to threadably engage said threaded pin.

2. A foldable table and seat assembly, as set forth in claim 1, wherein said operable position of said seat is adjacent an edge surface of said table, said edge surface defining an opening adapted to partially encircle a human body when seated in said seat.

3. A foldable table and seat assembly, as set forth in claim 1, wherein said table includes a balustrade adjacently disposed along at least one edge of the top surface of said table.

4. A foldable table and seat assembly, as set forth in claim 1, wherein at least one of the legs of said table is adapted to receive a pivot pin at a position adjacent a distal end of said leg, and said seat includes a pivot pin adapted to be pivotally connected to said leg.

5. A foldable table and seat assembly, as set forth in claim 1, wherein two adjacently positioned legs of said table are adapted to receive a pivot pin at a position adjacent respective distal ends of said legs, and said seat includes a pair of pivot pins each of which are adapted to be pivotally connected to a respective one of said adjacently positioned legs.

6. A foldable table and seat assembly, as set forth in claim 1, wherein said seat is separable from said table in response to disconnecting the pivotable attachment of said seat to said at least one of the legs of the table.

7. A foldable table and seat assembly, as set forth in claim 1, wherein each of said plurality of legs of the table comprise a first portion attached to said table and an extendable portion received in telescoping relationship within at least a portion of said first portion, said extendable portion having a distal end pivotally attached to said seat, said seat being separable from said table in response to withdrawing the extendable portion of each leg pivotally attached to said seat from engagement with the first portion of the respective leg.

8. A foldable seat comprising:

a planar bottom panel;

two planar side panels at least one of which is foldably attached to said bottom panel, each of said panels being movable between a folded position at which said side panel is disposed in parallel relationship with said bottom panel and an operable position at which said side panel is substantially orthogonally disposed with respect to said bottom panel and the other side panel, wherein a first one of said side panels is attached to said bottom panel by a hinge connection, a second one of said side panels is attached to said first side panel by a hinge connection and has an opening extending through said second panel at a predetermined position; and a threaded pin fixedly attached to said bottom panel and extending outwardly therefrom in coplanar relationship with said bottom panel at a position aligned with said opening through said second panel when said second panel is positioned at said operable position, and a threaded nut adapted to threadably engage said threaded pin.

* * * * *

UNITED STATES PATENT AND TRADEMARK OFFICE

CERTIFICATE OF CORRECTION

PATENT NO. : 5,711,572

DATED : January 27, 1998

INVENTOR(S) : Shaukat A. Khan

It is certified that error appears in the above-indentified patent and that said Letters Patent is hereby corrected as shown below:

Column 6, line 42 — After "planar", please add —side panels—.
Column 6, line 44 — After "which", please add —said—.

Signed and Sealed this

Second Day of June, 1998

Bruce Lehman

*Attest:*

BRUCE LEHMAN

*Attesting Officer*

*Commissioner of Patents and Trademarks*